US010833453B2

(12) United States Patent
Wang et al.

(10) Patent No.: US 10,833,453 B2
(45) Date of Patent: Nov. 10, 2020

(54) CABLE CONNECTOR

(71) Applicant: BizLink International Corp., New Taipei (TW)

(72) Inventors: Wen-Hsiung Wang, New Taipei (TW); Cheng-Wei Huang, New Taipei (TW); Hsueh-Yu Chao, New Taipei (TW)

(73) Assignee: BizLink International Corp., New Taipei (TW)

( * ) Notice: Subject to any disclaimer, the term of this patent is extended or adjusted under 35 U.S.C. 154(b) by 0 days.

(21) Appl. No.: 16/703,875

(22) Filed: Dec. 5, 2019

(65) Prior Publication Data

US 2020/0235524 A1 Jul. 23, 2020

(30) Foreign Application Priority Data

Jan. 18, 2019 (TW) ..... 108200916 U

(51) Int. Cl.
*H01R 13/635* (2006.01)
*H01R 12/77* (2011.01)

(52) U.S. Cl.
CPC ..... *H01R 13/635* (2013.01); *H01R 12/774* (2013.01)

(58) Field of Classification Search
CPC ..... H01R 13/6335; H01R 13/6273; H01R 13/633; H01R 13/6582; H01R 13/6575; H01R 13/6572
See application file for complete search history.

(56) References Cited

U.S. PATENT DOCUMENTS 5,558,534 A * 9/1996 Sarkady ..... H01R 13/6275 439/352
6,132,231 A * 10/2000 Suzuki ..... H01R 13/6275 439/352
6,319,040 B1 * 11/2001 Chang ..... H01R 13/6275 439/352
6,607,397 B1 * 8/2003 Zhang ..... H01R 13/193 439/357
6,957,976 B2 * 10/2005 Zhang ..... H01R 13/6275 439/358
6,988,908 B2 * 1/2006 Zhang ..... H01R 13/6275 439/358
7,025,620 B2 * 4/2006 Li ..... H01R 13/6275 439/358
7,081,003 B1 * 7/2006 Gregori ..... H01R 13/516 439/352

(Continued)

FOREIGN PATENT DOCUMENTS

CN 208336673 U * 1/2019

*Primary Examiner* — Briggitte R. Hammond
(74) *Attorney, Agent, or Firm* — CKC & Partners Co., LLC

(57) ABSTRACT

A cable connector includes a casing, a connecting portion, at least one pressing button, and at least one hook module. The connecting portion is disposed on a first direction surface of the casing for coupling with an electronic device connector, the pressing button is disposed on a third direction surface of the casing, and the hook module is disposed between the connecting portion and the pressing button. In addition, when the pressing button is pressed in the third direction, a hook end of the hook module is moved along a second direction on a protective shell of the connecting portion for separating from the electronic device connector.

6 Claims, 4 Drawing Sheets

(56) References Cited

U.S. PATENT DOCUMENTS

| | | | | |
|---|---|---|---|---|
| 7,112,076 | B2 * | 9/2006 | Wu | H01R 13/6335 439/160 |
| 7,445,486 | B2 * | 11/2008 | Shen | H01R 13/6273 439/353 |
| 9,397,442 | B2 * | 7/2016 | Sutter | H01R 24/62 |
| 2009/0004916 | A1 * | 1/2009 | Miyoshi | H01R 13/6581 439/607.41 |
| 2013/0045642 | A1 * | 2/2013 | Wu | G02B 6/3817 439/676 |
| 2020/0076132 | A1 * | 3/2020 | Yang | H01R 12/7064 |

* cited by examiner

CABLE CONNECTOR

RELATED APPLICATIONS

This application claims priority to Taiwan Application Serial Number 108200916, filed Jan. 18, 2019, which is herein incorporated by reference.

TECHNICAL FIELD

The present disclosure generally relates to a cable connector. More particularly, the present disclosure relates to a cable connector having a pulling belt.

BACKGROUND

With the development and innovation of various high frequency electronic products, new high frequency electronic products require relatively more bandwidth. Therefore, the world today relies on the rapid and reliable information transmission.

In addition, the rapid development of the information industry is very demanding on the performance of the server, and the first priority for maintaining the performance of the server is to maintain the operating temperature of the central processing unit thereof so that the heat dissipation solution thereof becomes very important. In order to achieve a better heat dissipation, most of the connectors of the server are placed in a non-intermediate position, such as the edge of the casing of the server rather than the center position thereof, to increase the space for allowing the airflow to flow smoothly, thereby effectively improving the heat dissipation performance of the central processing and the circuits thereof.

A conventional cable connector normally requires a resilient latch to engage with a corresponding connector of an electronic device to prevent the cable connector from being easily detached from the electronic device. Therefore, when a user is willing to separate a connecting portion of the cable connector from a corresponding connector of the electronic device, the user has to press the resilient latch with his finger. However, when the corresponding connector of the electronic device is placed too close to the edge of the electronic device, the user is difficult to press the resilient latch with his finger. In addition, even after the user presses the resilient latch, the cable connector must be pulled out by the finger of the user to separate from the corresponding connector of the electronic device. Therefore, a space for the fingers around the cable connector is required, thereby limiting the position and the number of the connectors of the electronic device.

SUMMARY

One objective of the embodiments of the present invention is to provide a cable connector for conveniently separating from an electronic device connector.

To achieve these and other advantages and in accordance with the objective of the embodiments of the present invention, as the embodiment broadly describes herein, the embodiments of the present invention provides a cable connector including a casing, a connecting portion, at least one pressing button and at least one hook module. The connecting portion is disposed on a surface of the casing to couple to an electronic device connector along a first direction. The pressing button is disposed on a surface of the casing along a third direction and the hook module is disposed between the connecting portion and the pressing button. The hook end of the hook module may move into a protective shell of the connecting portion along a second direction to separate from the electronic device connector when the pressing button is pressed along the third direction.

In some embodiments, the first direction, the second direction and the third direction are perpendicular to each other.

In some embodiments, the pressing button includes a rotational shaft pivoted on the casing.

In some embodiments, the protective shell of the connecting portion includes a hook opening and the hook end of the hook module passes through the hook opening to lock with the electronic device connector.

In some embodiments, the protective shell of the connecting portion further includes a hook fixing portion, and the hook module further includes a hook fixed end secured on the hook fixing portion.

In some embodiments, the hook module further includes a first extension portion, a U-shaped extension portion, a second extension portion, and a third extension portion. The first extension portion connects to the hook fixed end and extends along the second direction. The U-shaped extension portion connects to the first extension portion and extends parallel to the third direction with a U-shaped manner. The second extension portion connects to the U-shaped extension portion and extends parallel to the second direction. The third extension portion connects between the second extension portion and the hook end, and extends parallel to the first direction.

In some embodiments, the U-shaped extension portion includes a first extension arm, a second extension arm and an intermediate extension part. The first extension arm connects to the first extension portion, the second extension arm extends parallel to the first extension arm, and the intermediate extension part connects to the first extension arm and the second extension arm.

In some embodiments, the pressing button further includes a pressing portion and a rotating force action portion, and the rotating force action portion presses on the second extension arm of the U-shaped extension portion when the pressing portion is pressed.

In some embodiments, the cable connector further includes a pulling belt surrounding the casing, the connecting portion and the pressing button.

In some embodiments, the pulling belt includes a pulling belt opening, and the connecting portion passes through the pulling belt via the pulling belt opening.

Hence, the cable connector can be easily detached from the electronic device connector and conveniently utilized with the electronic device connector even located close to the edge of the electronic device. The user only needs to press the pressing buttons or pull the pulling belt to detach the cable connector from the electronic device connector.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENT

The following description is of the best presently contemplated mode of carrying out the present disclosure. This description is not to be taken in a limiting sense but is made merely for the purpose of describing the general principles of the invention. The scope of the invention should be determined by referencing the appended claims.

Figure 1:
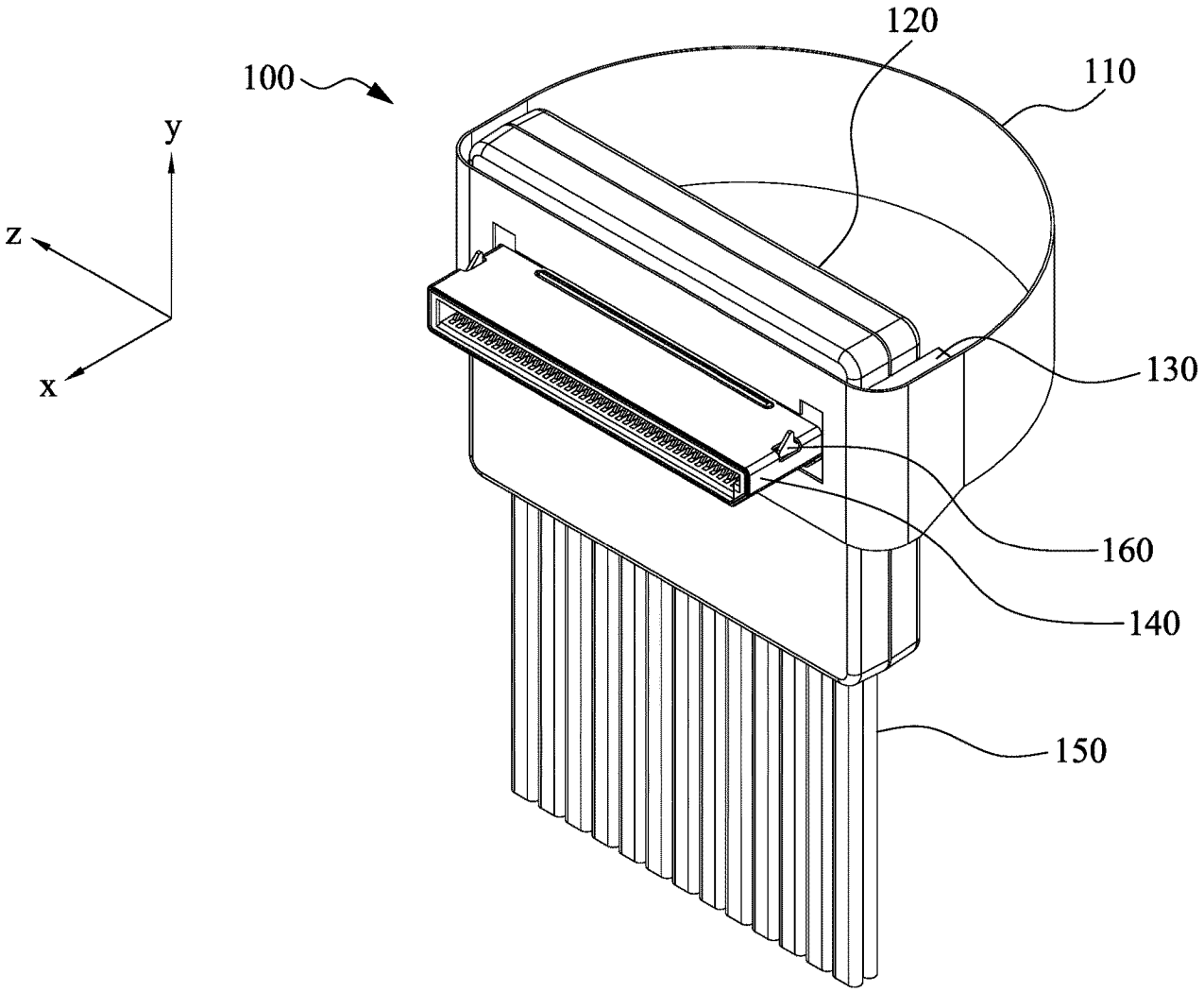
FIG. 1 illustrates a perspective view of a cable connector according to one embodiment of the present invention.
Figure 2:
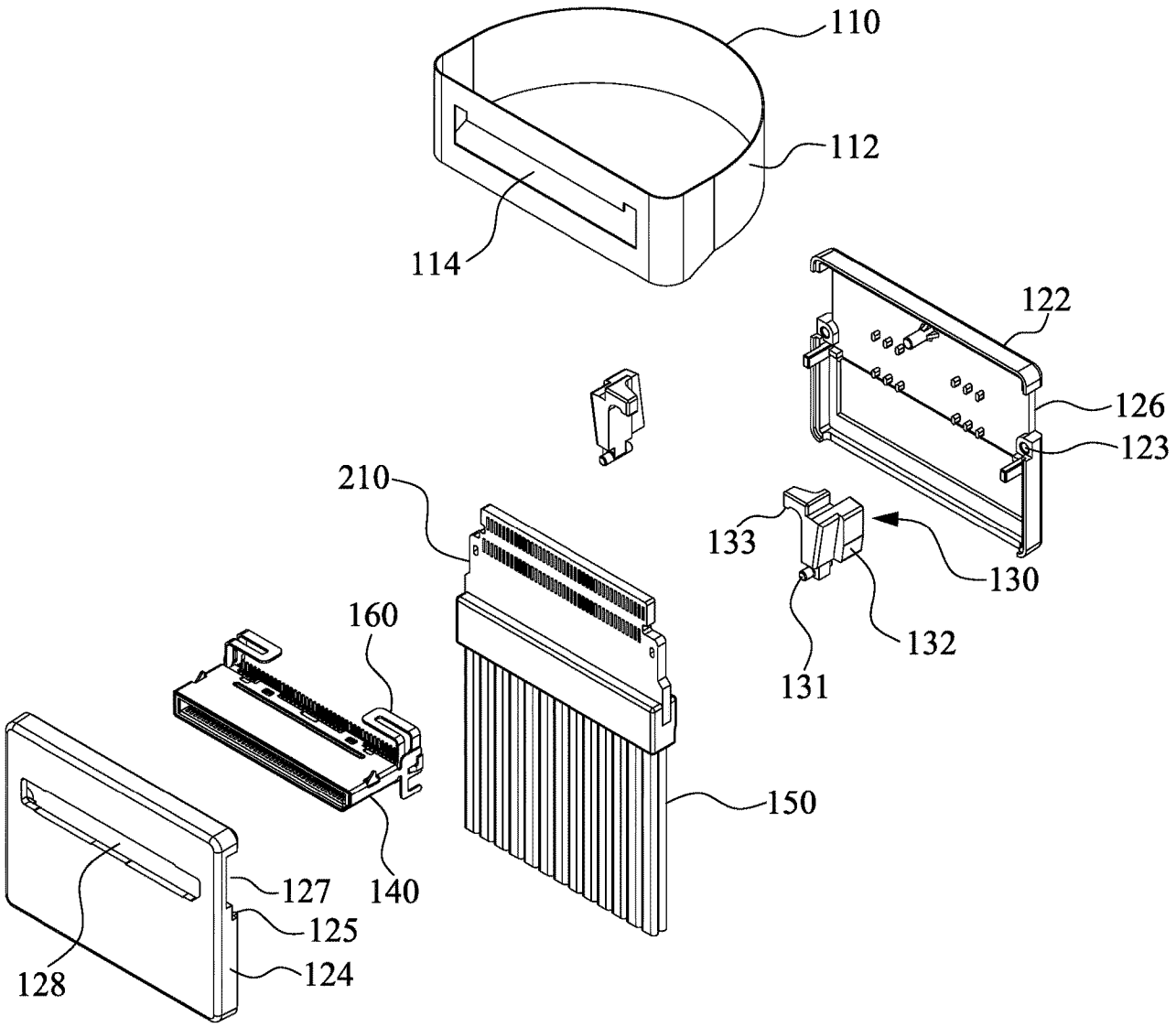
FIG. 2 illustrates an exploded perspective view of a cable connector according to one embodiment of the present invention.
Figure 3:
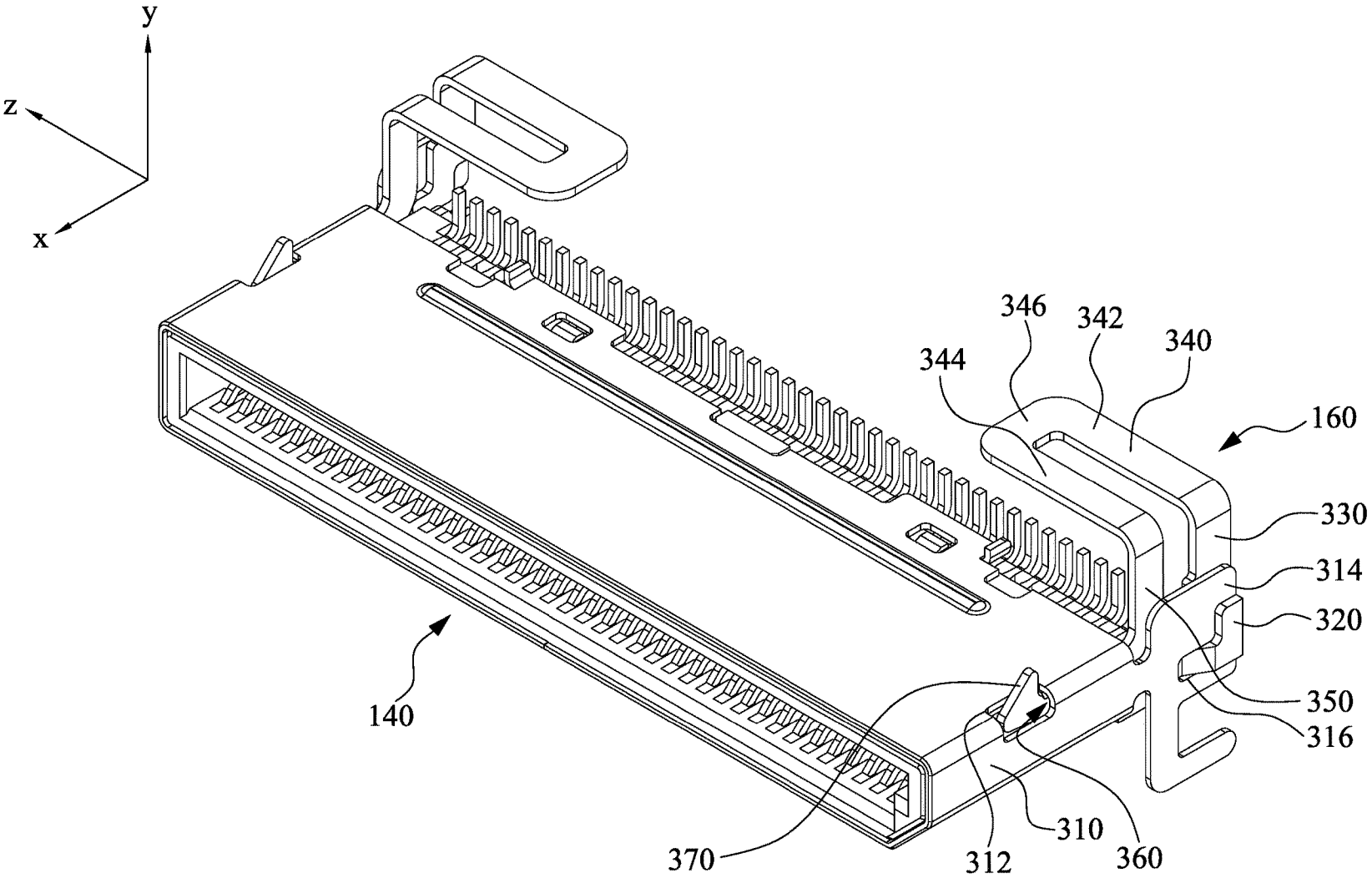
FIG. 3 illustrates a partial perspective view of a connecting portion and a hook module of the cable connector according to one embodiment of the present invention.
Figure 4:
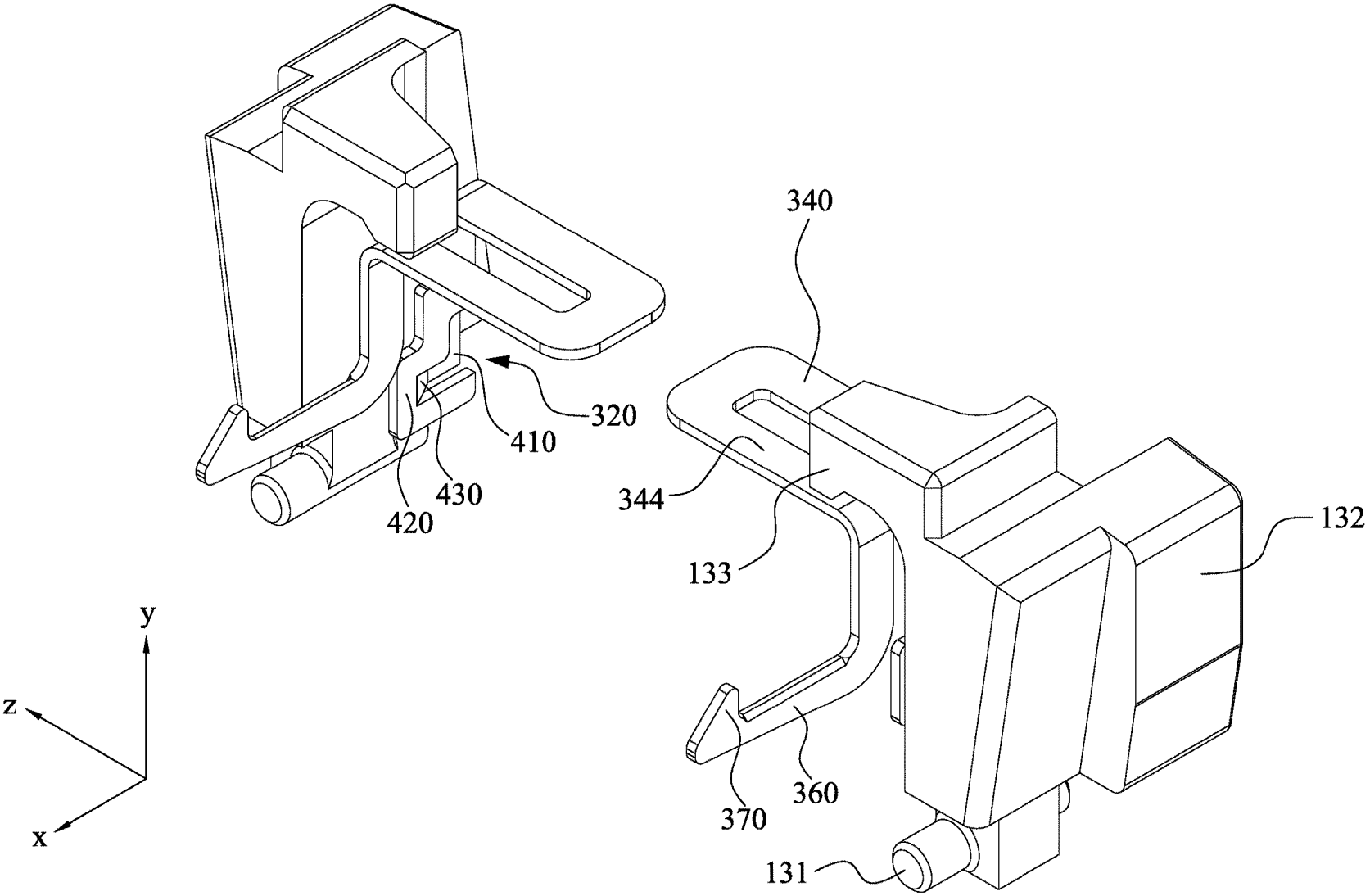
FIG. 4 illustrates a partial perspective view of a pressing button and a hook module of the cable connector according to one embodiment of the present invention.

FIG. 1 illustrates a perspective view of a cable connector according to one embodiment of the present invention, FIG. 2 illustrates an exploded perspective view thereof, FIG. 3 illustrates a partial perspective view of a connecting portion and a hook module thereof, and FIG. 4 illustrates a partial perspective view of a pressing button and a hook module thereof.

Referring to FIGS. 1-4, a cable connector 100 includes a casing 120, a connecting portion 140, two pressing buttons 130 and two hook modules 160. Additionally, in the specification of the present invention, the X direction is described as a first direction, the Y direction is described as a second direction, and the Z direction is described as a third direction. However, it is only for convenience to describe the connection relationship and action direction of the cable connector 100, and is not intended to limit the spirit and scope of the present invention.

The connecting portion 140 is equipped on a surface along the first direction, i.e. X direction, of the casing 120 to couple to an electronic device connector. The pressing button 130 is disposed on a surface along a third direction, i.e. Z direction, of the casing 120. The hook module 160 is disposed between the connecting portion 140 and the pressing button 130. When the pressing button 130 is pressed along the third direction, the hook end 370 of the hook module 160 moves into the protective shell 310 of the connecting portion 140 along the second direction, i.e. Y direction, to separate from the electronic device connector.

It is worth noting that the cable connector 100 further includes a pulling belt 110, for example, a pulling belt action ring 112, surrounding the casing 120, the connecting portion 140 and the pressing button 130 to conveniently press the pressing button 130. When the pulling belt 110 is pulled towards an opposite direction of the first direction, −X direction, the pulling belt 110 presses on the pressing buttons 130 to withdraw the hook ends 370 of the hook module 160 from the protective shell 310 of the connecting portion 140 for separating from the electronic device connector. In addition, because that the pulling belt 110 is pulled toward the −X direction, the pulling belt 110 can simultaneously pull out the cable connector 100 from the electronic device connector. Hence, a user can separate the cable connector 100 from the electronic device connector with only one finger rather than holding and pulling out the cable connector 100 with at least two fingers.

In some embodiments, if the space around the cable connector 100 is enough to operate the pressing button 130 by a user's fingers, the user may also use two fingers to directly press the pressing buttons 130 on the left and right surfaces of the cable connector 100 to move the hook end 370 of the hook module 160 into the protective shell 310 of the connecting portion 140, thereby separating the cable connector 100 from the electronic device connector without departing from the spirit and scope of the present invention.

In some embodiments, the pulling belt 110 further includes a pulling belt opening 114 to allow the connecting portion 140 passing through the pulling belt 110 via the pulling belt opening 114.

In some embodiments, the pressing button 130 includes a rotational shaft 131 pivoted on the casing 120. The casing 120 includes a first cover 122 and a second cover 124, the first cover 122 and the second cover 124 including a pivot hole 123 and a pivot hole 125 to allow the pressing button 130 rotatable on the casing 120 with the rotational shaft 131.

In addition, the first cover 122 and the second cover 124 further include a pressing button opening 126 and a pressing button opening 127 combined with the pressing button opening 126 to form a complete opening to allow the pressing button 130 rotating therein so that the pressing button 130 can rotate in the pressing button opening and come into contact with the hook module 160.

The second cover 124 further includes a connection opening 128 to allow the connecting portion 140 passing through the casing 120. The pressing button opening 126 and the pressing button opening 127 may formed on the Z direction surface and the −Z direction surface of the casing 120 and the connection opening 128 may formed on the X direction surface thereof.

In some embodiments, the protective shell 310 of the connecting portion 140 includes a hook opening 312 to allow the hook end 370 of the hook module 160 penetrating through the hook opening 312 to lock with the electronic device connector.

In some embodiments, the protective shell 310 of the connecting portion 140 includes a hook fixing portion 314, and the hook module 160 further includes a hook fixed end 320. The hook fixed end 320 is fixed on the hook fixing portion 314, for example, the hook fixed end 320 is welded on the hook fixing portion 314.

In some embodiments, the protective shell 310 of the connecting portion 140 includes a hook fixing opening 316, and the hook fixed end 320 of the hook module 160 is fixed in the hook fixing opening 316. As illustrated in FIG. 4, the hook fixed end 320 includes a clamping portion 410, a fixing base 420 and an engagement portion 430 connecting to the clamping portion 410 and the fixing base 420 to engage with the hook fixing opening 316, thereby increasing the fixing strength between the hook fixed end 320 and the hook fixing portion 314.

In some embodiments, the hook module 160 further includes a first extension portion 330, a U-shaped extension portion 340, a second extension portion 350 and a third extension portion 360. The first extension portion 330 connects to the hook fixed end 320, and extended along the Y direction. The U-shaped extension portion 340 connects to the first extension portion 330, and extends with a U-shaped manner along Z direction. The second extension portion 350 connects to the U-shaped extension portion 340, and extends parallel to the Y direction. The third extension portion 360 connects the second extension portion 350 to the hook end 370, and extends parallel to the X direction.

In some embodiments, the U-shaped extension portion 340 further includes a first extension arm 342 connected to the first extension portion 330, a second extension arm 344 parallel to the first extension arm 342, and an intermediate extension part 346 connected to the first extension arm 342 and the second extension arm 344. In addition, the pressing button 130 further includes a pressing portion 132 and a rotating force action portion 133. When the pressing portion 132 is pressed, the rotating force action portion 133 presses on the second extension arm 344 of the U-shaped extension portion 340 to force the hook end 370 moving into the hook opening 312 of the protective shell 310, thereby separating the cable connector 100 from electronic device connector.

In some embodiments, the cable connector 100 further includes a printed circuit board 210 connected to a plurality of wires of the cable 150 and connected to the connecting portion 140. For example, the connecting portion 140 is welded on a surface of the printed circuit board 210 and perpendicular to the surface of the surface of the printed circuit board 210. In addition, the cable 150 is welded on the surface of the printed circuit board 210, and parallel to the surface of the printed circuit board 210.

Accordingly, the cable connector can be easily detached from the electronic device connector and conveniently utilized with the electronic device connector even located close to the edge of the electronic device. The user only needs to press the pressing buttons or pull the pulling belt to detach the cable connector from the electronic device connector.

As is understood by a person skilled in the art, the foregoing preferred embodiments of the present invention are illustrative of the present invention rather than limiting of the present invention. It is intended that various modifications and similar arrangements be included within the spirit and scope of the appended claims, the scope of which should be accorded the broadest interpretation so as to encompass all such modifications and similar structures.

What is claimed is:

1. A cable connector, comprising:

a casing;

a connecting portion disposed on a surface of the casing to couple to an electronic device connector along a first direction;

at least one pressing button disposed on a surface of the casing along a third direction; and at least one hook module disposed between the connecting portion and the pressing button, wherein a hook end of the hook module moves into a protective shell of the connecting portion along a second direction to separate from the electronic device connector when the pressing button is pressed along the third direction, wherein the first direction, the second direction and the third direction are perpendicular to each other, the pressing button comprises a rotational shaft pivoted on the casing, the protective shell of the connecting portion comprises a hook opening and the hook end of the hook module passes through the hook opening to lock with the electronic device connector, the protective shell of the connecting portion further comprises a hook fixing portion, and the hook module further comprises a hook fixed end secure on the hook fixing portion.

2. The cable connector of claim 1, wherein the hook module further comprises:

a first extension portion connecting to the hook fixed end and extending along the second direction;

a U-shaped extension portion connecting to the first extension portion and extending parallel to the third direction with a U-shaped manner;

a second extension portion connecting to the U-shaped extension portion and extending parallel to the second direction; and a third extension portion connecting between the second extension portion and the hook end and extending parallel to the first direction.

3. The cable connector of claim 2, wherein the U-shaped extension portion comprises:

a first extension arm connecting to the first extension portion;

a second extension arm parallel to the first extension arm; and an intermediate extension part connecting to the first extension arm and the second extension arm.

4. The cable connector of claim 3, wherein the pressing button further comprises a pressing portion and a rotating force action portion, and the rotating force action portion presses on the second extension arm of the U-shaped extension portion when the pressing portion is pressed.

5. The cable connector of claim 1, further comprising a pulling belt surrounding the casing, the connecting portion and the pressing button.

6. The cable connector of claim 5, wherein the pulling belt comprises a pulling belt opening, and the connecting portion passes through the pulling belt via the pulling belt opening.

* * * * *